US011821212B2

(12) United States Patent
Heimbuck et al.

(10) Patent No.: US 11,821,212 B2
(45) Date of Patent: Nov. 21, 2023

(54) DROP CANOPY WITH SCREEN

(71) Applicant: Carefree/Scott Fetzer Company, Broomfield, CO (US)

(72) Inventors: Gregory Keith Heimbuck, Arvada, CO (US); David Thomas McMillan, Louisville, CO (US); Vincent J. Frerich, Arvada, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 279 days.

(21) Appl. No.: 17/024,434

(22) Filed: Sep. 17, 2020

(65) Prior Publication Data

US 2021/0079659 A1 Mar. 18, 2021

Related U.S. Application Data

(60) Provisional application No. 62/901,986, filed on Sep. 18, 2019.

(51) Int. Cl.
*E04F 10/06* (2006.01)

(52) U.S. Cl.
CPC ..... *E04F 10/0666* (2013.01); *E04F 10/0614* (2013.01); *E04F 10/0629* (2013.01); *E04F 10/0648* (2013.01)

(58) Field of Classification Search
CPC ..... E04F 10/0666; E04F 10/0614; E04F 10/0629; E04F 10/0648; E04F 10/0681; E04F 10/0685; E04F 10/0696
See application file for complete search history.

(56) References Cited

U.S. PATENT DOCUMENTS 3,900,063 A * 8/1975 Roller ..... E06B 9/70 160/310
4,214,621 A * 7/1980 Wessels ..... E04F 10/0633 160/68
5,819,831 A * 10/1998 Schanz ..... E06B 9/174 242/399
6,971,433 B2 * 12/2005 Wagner ..... E04F 10/0614 160/67
7,740,044 B2 * 6/2010 Gutierrez ..... E04F 10/0625 160/67
8,016,016 B2 * 9/2011 Berman ..... E06B 9/50 160/242
8,220,520 B2 * 7/2012 Lukos ..... G03B 21/58 160/242

(Continued)

*Primary Examiner* — Abe Massad
(74) *Attorney, Agent, or Firm* — Watts Law LLC; John A. Yirga, Esq.

(57) ABSTRACT

An awning assembly and method of construction comprising a roll bar extending laterally between first and second arms. The roll bar comprising a removable and replaceable roller tube portion defining a wide opening within the roll bar and an inner roller mechanism housed within the wide opening. The inner roller mechanism comprising a drop end bracket rotatably and slidably coupling a second roll bar to the roll bar, the second roll bar extending laterally within the roll bar, a screen supported by the second roll bar, wherein the screen is extendable or retractable responsive to rotation of the second roll bar, and a tray supporting the second roll bar during extension and retraction of the screen, the tray supported by the removable and replaceable roller tube portion.

20 Claims, 14 Drawing Sheets

(56) References Cited

U.S. PATENT DOCUMENTS

| | | | | |
|---|---|---|---|---|
| 2017/0130526 | A1* | 5/2017 | Gasparrini | E06B 9/40 |
| 2017/0321427 | A1* | 11/2017 | Thompson | E04F 10/0607 |
| 2018/0087319 | A1* | 3/2018 | McPherson | E06B 9/50 |
| 2018/0320381 | A1* | 11/2018 | Ma | E04F 10/0618 |
| 2018/0335687 | A1* | 11/2018 | Enochs | F16M 11/18 |

* cited by examiner

DROP CANOPY WITH SCREEN

CROSS-REFERENCE TO RELATED APPLICATIONS

The following application claims priority under 35 U.S.C. 119(e) to U.S. Provisional Patent Application Ser. No. 62/901,986 filed Sep. 18, 2019 entitled DROP CANOPY WITH SCREEN. The above-identified application from which priority is claimed is incorporated herein by reference in its entirety for all purposes.

FIELD OF THIS DISCLOSURE

The present disclosure relates to a design and method of use of a canopy with a drop screen, and more specifically, a drop down shade and/or projector screen.

BACKGROUND

An awning is a welcome addition to a house, recreational vehicle, or other dwelling. The awning typically provides increased enjoyment of an outdoor area surrounding the dwelling. The awning can cast a shaded area that creates an escape from direct sunlight, thereby providing a space in which an occupant of the dwelling may relax. The shaded area created by the awning contributes to the relaxation of the occupant in that there is a perceived decrease in temperature and, thus, generally becomes more comfortable. The awning as well advantageously protects occupants underneath from precipitation.

Known awning structures generally consist of a base that is permanently affixed to the dwelling, and a canopy that is removably attached to the base. Conventional awning structures are discussed in detail further in U.S. Pat. No. 6,971,433 assigned to Carefree/Scott Fetzer Company. U.S. Pat. No. 6,971,433 is incorporated herein by reference in its entirety for all purposes.

SUMMARY

One aspect of the present disclosure incudes an awning assembly comprising a roll bar extending laterally between first and second arms. The roll bar comprising a removable and replaceable roller tube portion defining a wide opening within the roll bar and an inner roller mechanism housed within the wide opening. The inner roller mechanism comprising a drop end bracket rotatably and slidably coupling a second roll bar to the roll bar via a connector bracket, the second roll bar extending laterally within the roll bar, a screen supported by the second roll bar, wherein the screen is extendable or retractable responsive to rotation of the second roll bar.

Another aspect of the present disclosure includes an awning assembly comprising a roll bar supporting a canopy, the canopy couplable to a dwelling at a first end and coupled to the roll bar at a second end, the roll bar extends along a lateral axis between first and second arms, the first and second arms couplable to the dwelling at a first end, and supporting the roll bar at a second end, the first and second arms extend or retract the canopy by extending or retracting the arms. The roll bar comprises a removable and replaceable roller tube portion defining a wide opening within the roll bar, an opening extending along the lateral axis, and an inner roller mechanism comprising a second roll bar housed within the wide opening. The inner roller mechanism comprises a drop end bracket defining first and second slide brackets spaced by a rotation bracket, first and second slide portions housed within the first and second slide brackets support the second roll bar and a rotation mount housed within the rotation bracket rotatably and slidably coupling the second roll bar to the roll bar, the second roll bar extending laterally within the roll bar and a screen supported by the second roll bar and extending through the first opening, a connecting bracket defining first and second through holes and a rotation through hole, the first and second slide brackets at least partially housed within the first and second through holes, wherein the screen is extendable or retractable responsive to rotation of the second roll bar.

Yet another aspect of the present disclosure includes an awning assembly comprising a roll bar extending along a lateral axis between first and second arms. The roll bar comprises a removable and replaceable roller tube portion defining a wide opening within the roll bar and an inner roller mechanism housed within the wide opening. The inner roller mechanism comprises a drop end bracket defining first and second slide brackets spaced by a rotation bracket, a connecting element defining first and second through holes and a rotation through hole, a rotation mount housed within the rotation bracket and the rotation through hole rotatably and slidably coupling a second roll bar to the roll bar, the second roll bar extending laterally within the roll bar, the rotation mount and the first and second slide portions move along a first axis responsive to the second roll bar extending or retracting, further wherein the first and second slide brackets and the first and second through holes support one or more slide portions that interact with the second roll bar to inhibit movement along a second axis, the first axis transverse to the second axis and the lateral axis, and the second axis transverse to the lateral axis. The inner roller mechanism further including a screen supported by the second roll bar, wherein the screen is extendable or retractable responsive to rotation of the second roll bar, and a tray supporting the second roll bar during extension and retraction of the screen, the tray supported by the removable and replaceable roller tube portion.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 1:
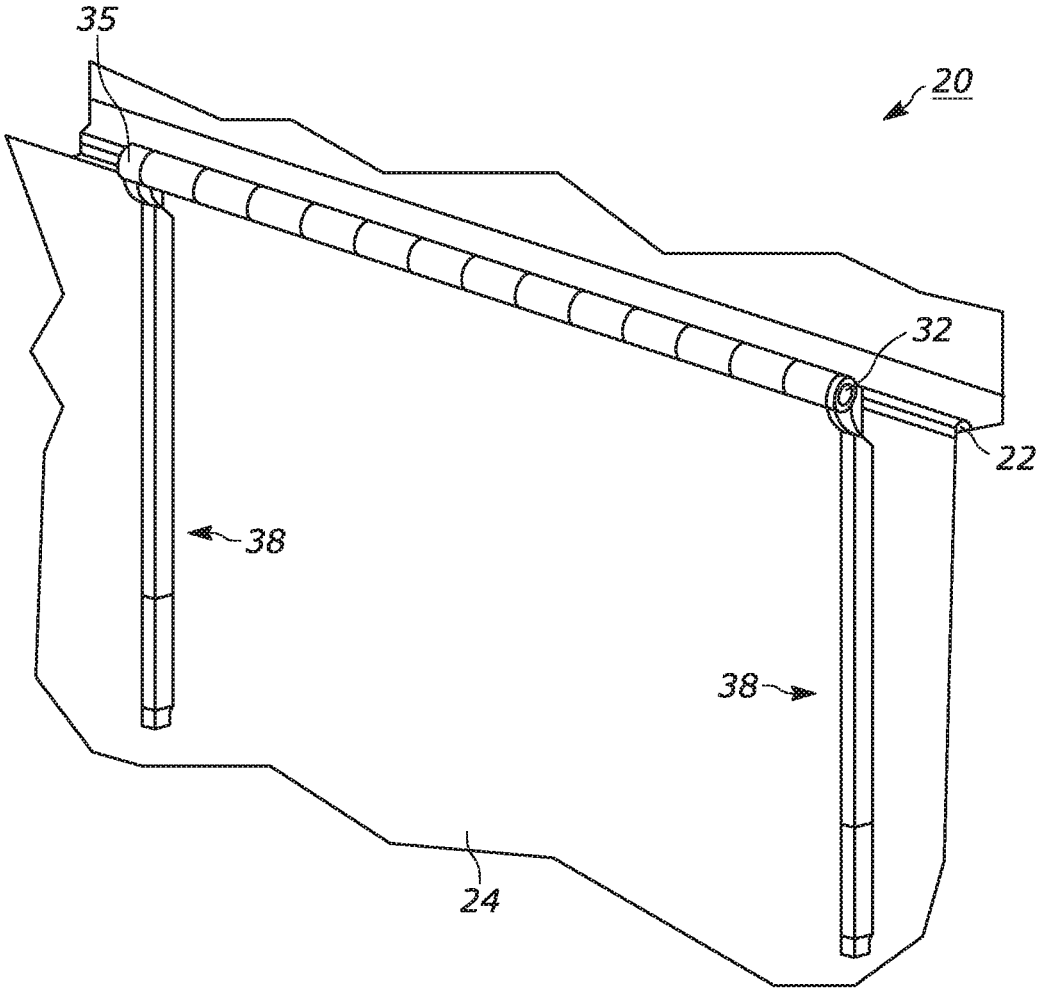
FIG. 1 is a side elevation view of an awning canopy assembly in a retracted position in accordance with one example embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a design and method of use for a canopy with a drop screen, and more specifically, a drop down shade and/or projector screen.

Figure 2:
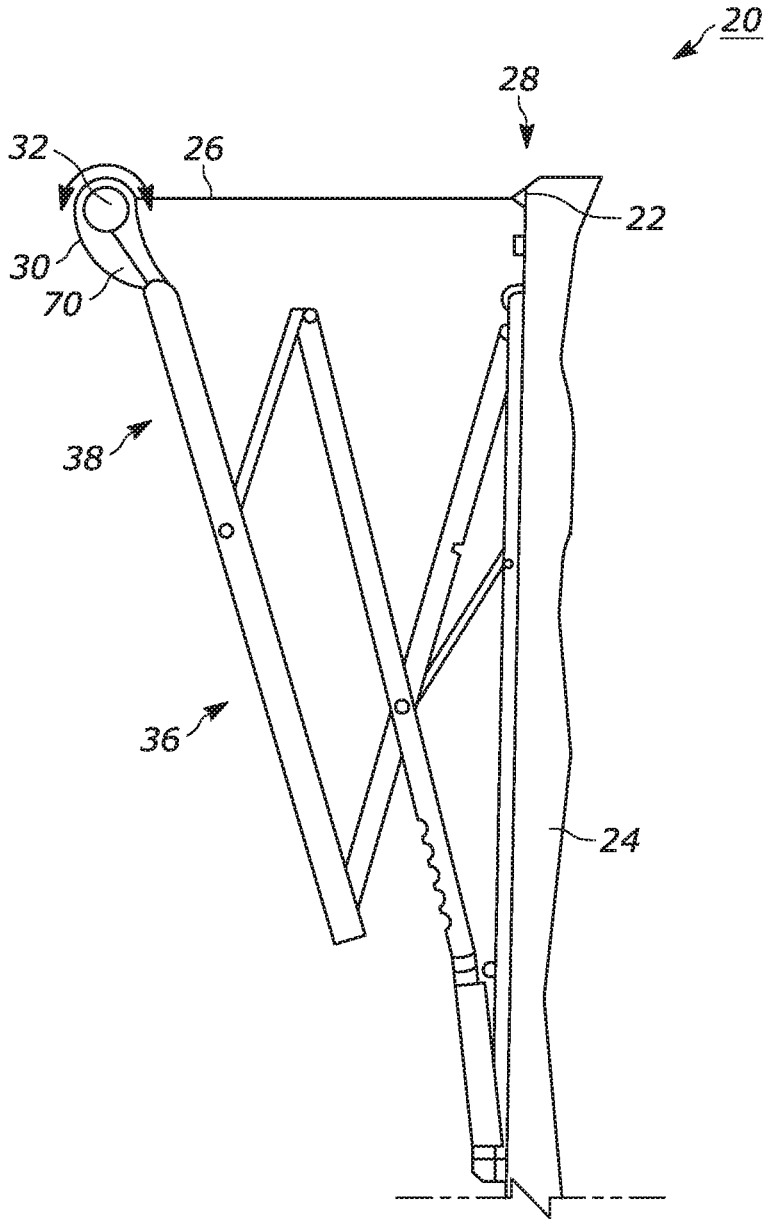
FIG. 2 is a left side elevation view of an awning canopy assembly in a partially expanded or partially open position in accordance with one example embodiment of the present disclosure.

Now referring to FIGS. 1-2, an awning assembly 20 is illustrated. The awning assembly 20 includes a flexible awning canopy 26 that is mounted to a vertical support surface 24, which might be for example, the side wall of a recreational vehicle, mobile home, a recreational vehicle slide-out, or more permanent building structure. The flexible awning canopy 26 includes an inner or proximal edge 28 secured to a support rail 22 and an outer edge 30 secured to a roll bar 32, which can be motor, manual, or spring driven by one or more motors, gears, or springs that are operatively connected to, and maintained by, a support system 36 in the form of a pair of scissor-type arms 38. In one example embodiment, the roll bar 32 is coupled to the pair of scissor-type arms 38 via one or more end caps 70. The awning canopy 26 is rolled onto or unrolled from the roll bar 32 causing the awning 20 to retract or extend, respectively. As illustrated in the example embodiments of FIGS. 4-6, and 9, the canopy 26 is attached to the roll bar 32 via a first polyrod (not shown) that is housed within a first channel 60*a* on the roll bar and the valence 34 is attached to the roll bar via a second polyrod (not shown) that is housed within a second channel 60B. The roll bar 32 further defines a first opening 33 extending along a z direction. In one example embodiment, the first opening 33 extends from a first lateral side 64*a* to a second lateral side 64*b*. In another example embodiment, the first opening 33 has a first opening length 33*a*. The first opening length 33*a* is at least one of less than or equal to a length of the roll bar 32. In another example embodiment, the first opening 33 has a first opening width 33*b*. In one example embodiment, the first opening width 33*b* is constant. In another example embodiment, the first opening width 33*b* gets wider as it extends away from a first end 68*a* and narrows as it returns to a second end 68*b* of the roll bar 32. It would be appreciated by one having ordinary skill in the art that the first opening may comprise different lengths and widths, and define rectangular or other geometric shapes.

It would be appreciated by one having ordinary skill in the art that additional example embodiments of the awning assembly 20 are contemplated. In one such example embodiment, the awning assembly 20 has support arms 38 that retract up and/or rotate inwards such as towards the roll bar 32. Stated another way, the support system 36 when in the contracted position (see FIG. 1) can rotate such that the support system 36, which includes vertical tracks (not shown), are parallel with the roll bar 32.

Figure 3:
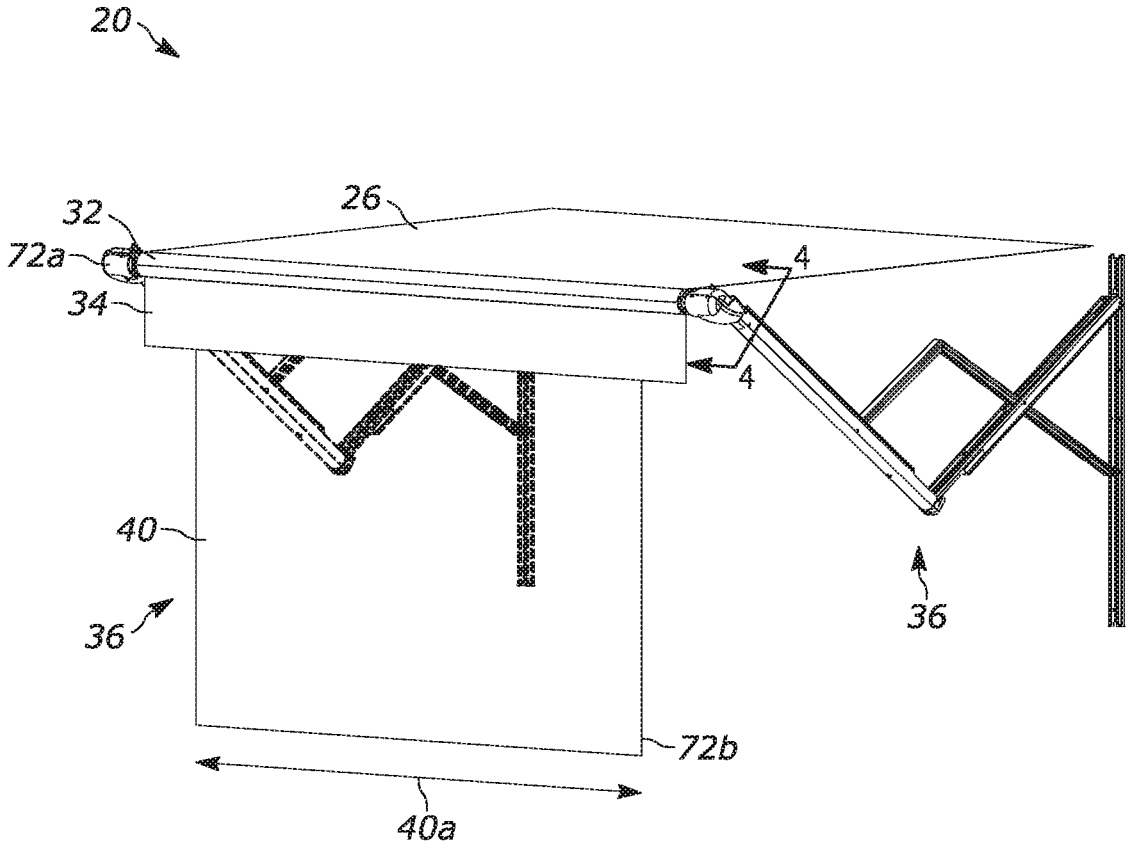
FIG. 3 is a perspective view of an awning canopy assembly in an open or expanded position including an unrolled screen in accordance with one example embodiment of the present disclosure.
Figure 3A:
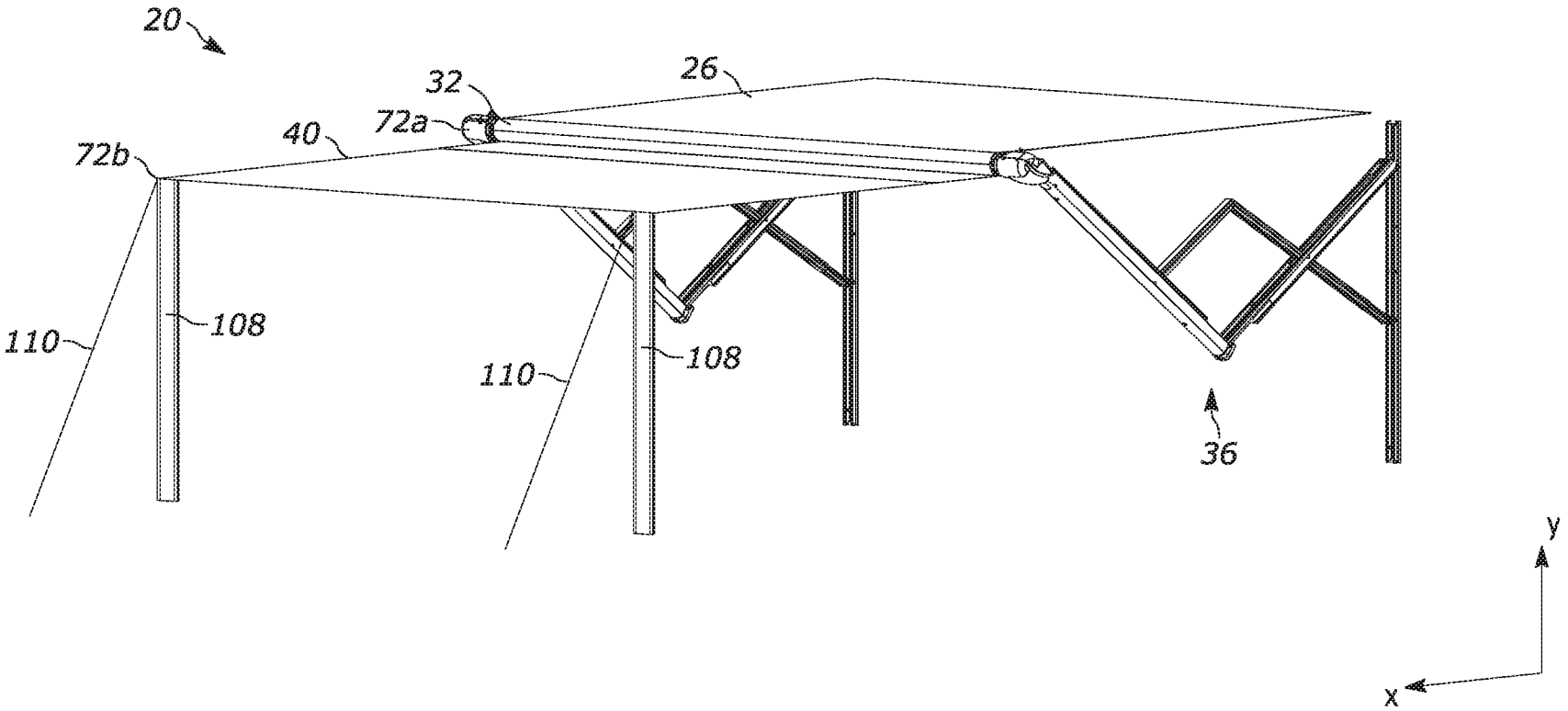
FIG. 3A is a perspective view of an awning canopy assembly in an open or expanded position including an unrolled extended screen in accordance with one example embodiment of the present disclosure.
Figure 4:
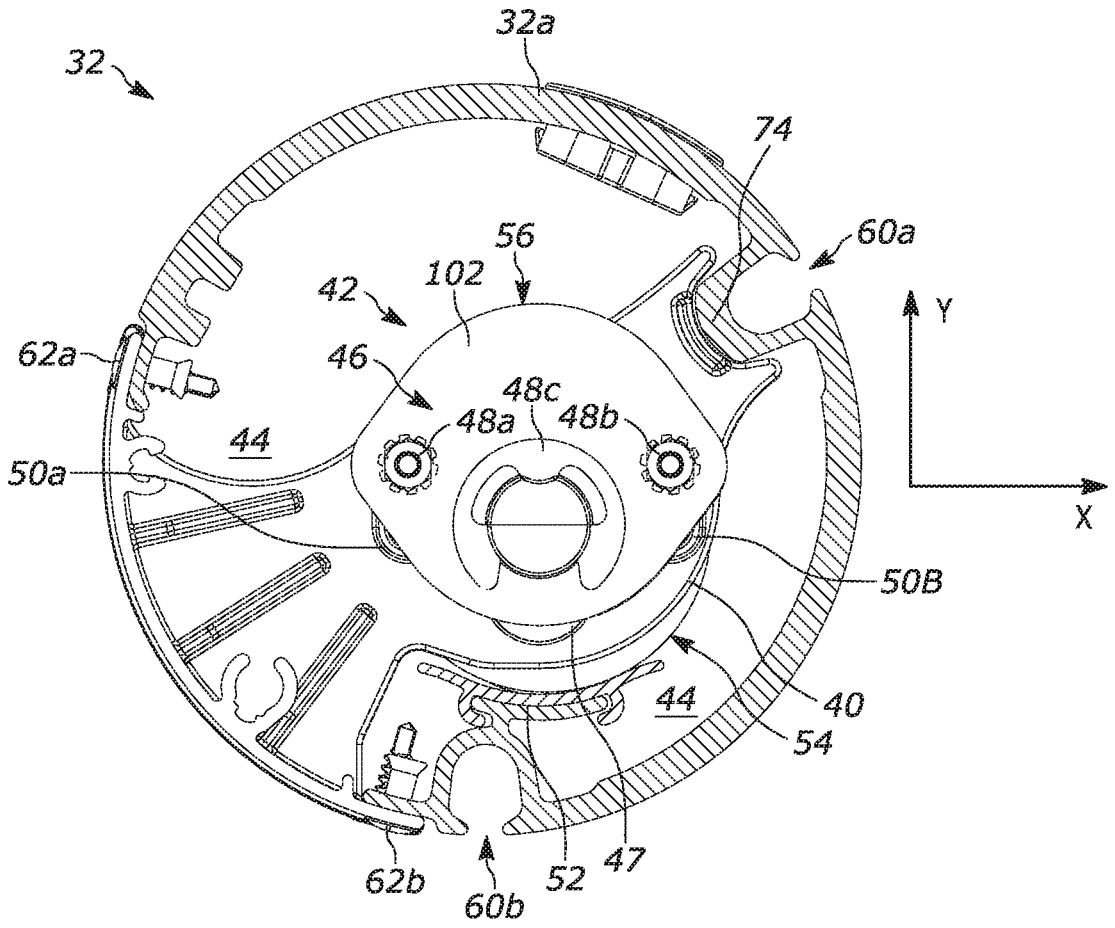
FIG. 4 is a right side exterior elevation view of inner roller mechanism of an awning canopy assembly support system taken along section lines 4-4 of FIG. 3.
Figure 5:
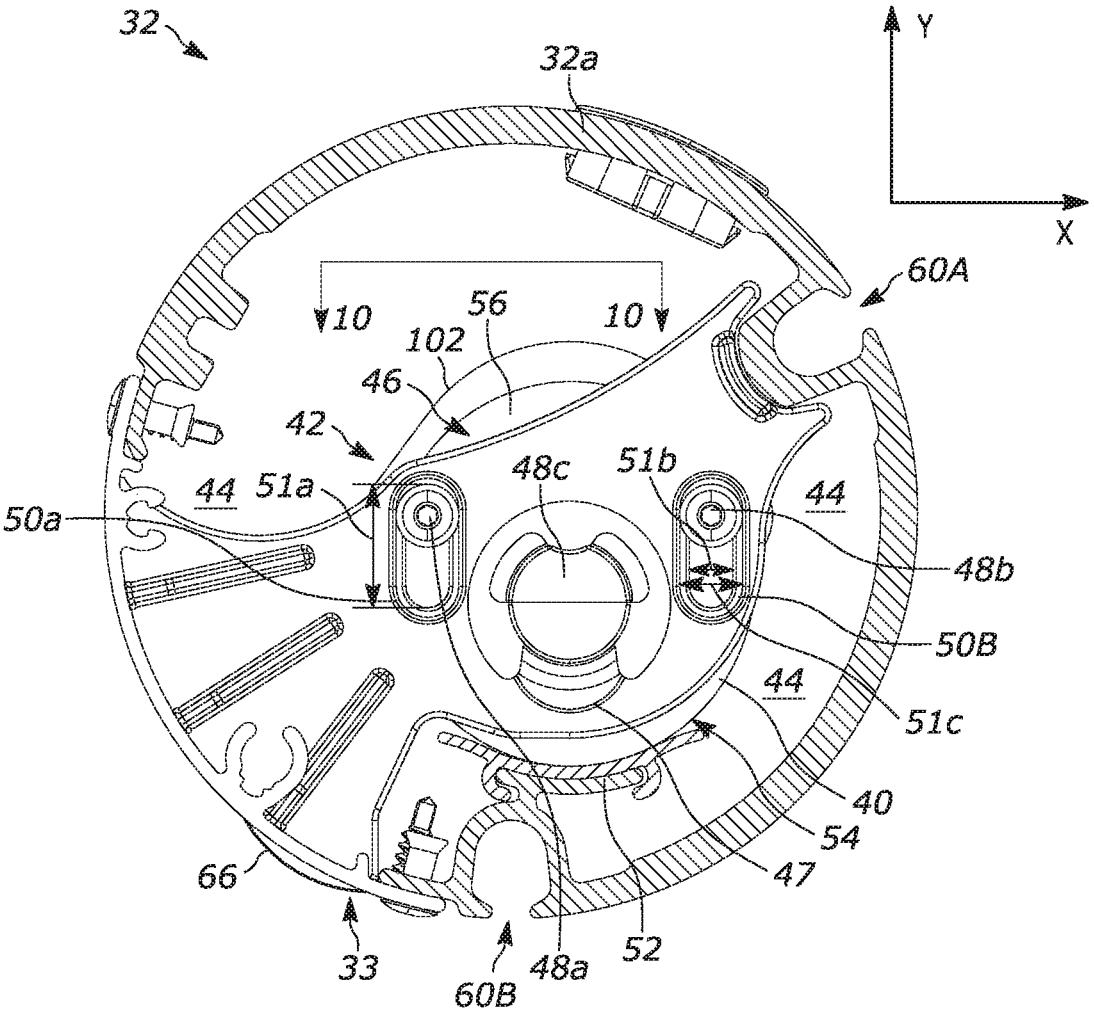
FIG. 5 is a left side interior elevation view of FIG. 4 with a retracted screen of an awning canopy assembly support system in accordance with another example embodiment of the present disclosure.

As illustrated in FIG. 3, a valence 34 and a drop screen/material 40 extend from the roll bar 32. In this example embodiment, the drop screen 40 comprises a full view shade material or a projection material, such as matt white, matt white rear coated, reference white, and/or reference grey. In another example embodiment, the drop screen 40 comprises an SPF 50 or above shade material, an opaque material, a reflective material, or the like. As illustrated in the example embodiment of FIG. 3A, the drop screen 40 is extended from the roll bar 32 along the x axis. In this example embodiment, a second end 72*b* of the drop screen 40 is coupled to and supported by one or more legs 108. In some example embodiments, the one or more legs 108 are supported by one or more guy ropes 110. The guy ropes are secured to one of a surface, a stationary object, a stake, or the like.

As illustrated in FIGS. 4-6, 8, and 12, the roll bar 32 includes an inner roller mechanism 42. The roll bar 32 further includes a removable and replaceable roller tube portion 32*a* that defines a wide opening 44 within the roll bar for installation and removal of the inner roller mechanism 42. The removable and replaceable roller tube portion 32*a* is couplable to and removable from the roll bar 32 via connectors 62*a*, 62*b*, such as a threaded attachment (e.g. a lug nut and screw), a bolted attachment (e.g. a bolt) and/or a combination thereof. In one example embodiment, the removable and replaceable roller tube portion 32*a* is supported by connection locations wherein the connectors 62*a*, 62*b* are attached and a support location 74 that comprises a complementary shape to a protrusion of the removable and replaceable roller tube portion.

The inner roller mechanism 42 includes a drop mounting 46 of a second roll bar 54 housed within the roll bar 32. The drop mounting 46 includes drop end brackets 56 coupled to opposing ends of the roll bar 32 and the second roll bar 54. The drop end brackets 56 define one or more slide brackets 50A, 50B and a rotation bracket 47. Wherein, one or more slide portions 48*a*, 48*b* slidably reside within the one or more slide brackets 50A, 50B, and a rotation mount 48*c* slidable and rotationally resides within the rotation bracket 47. The one or more slide portions 48*a*, 48*b* and the rotation mount 48*c* are coupled to and support the second roll bar 54 within the roll bar 32. The rotation mount 48*c* allows the second roll bar 54 to rotate within the rotation bracket 47 while the one or more slide portions 48*a*, 48*b* reside in one or more slide brackets 50A, 50B of the roll bar 32. Further, a connecting bracket 102 defining first and second through holes 104*a*, 104*b* spaced by a rotation through hole 106 is coupled to the second roll bar 54. In one example embodiment, the first and second through holes 104*a*, 104*b* support at least a portion of the one or more slide portions 48*a*, 48*b*. In this embodiment, the rotation through hole 106 supports at least a portion of the rotation mount 48*c*. In one example embodiment, the connecting bracket 102 is spaced from the drop end bracket 56.

As illustrated in FIGS. 4, 6A, 12 and 15, the one or more slide portions 48*a*, 48*b* each have a slide connector 86 (e.g., a lug nut, connector piece, threaded element, etc.) and an end bracket 84 coupled together by a slide bracket interaction area 82. In one example embodiment, the slide bracket interaction area 82 supports a spacer element 83. The spacer element 83 divides the slide bracket interaction area 82 into first and second interaction areas 82*a*, 82*b*.

Figure 15:
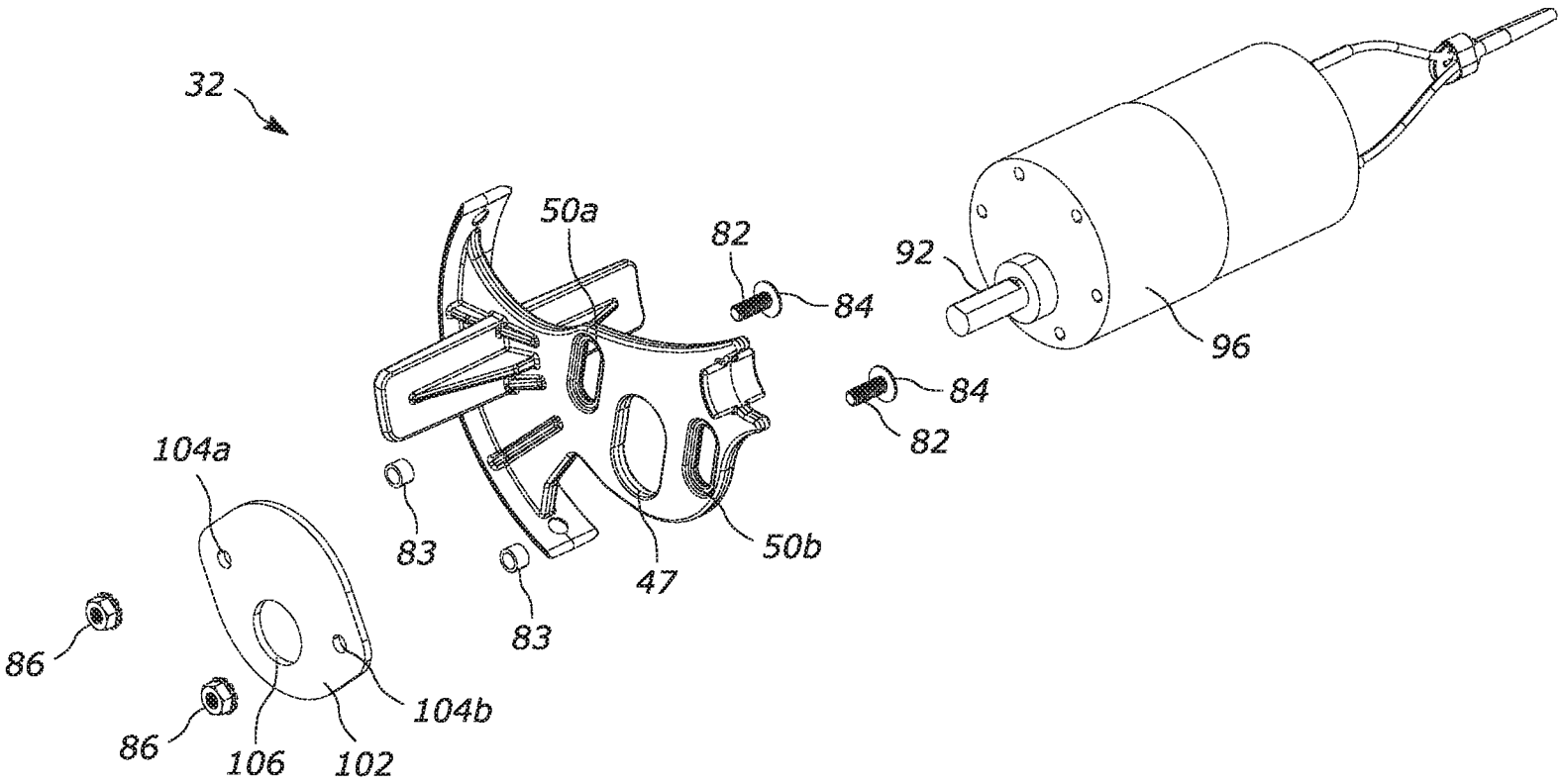
FIG. 15 is an exploded perspective view of drop end bracket, second roll bar, and connecting elements in accordance with one example embodiment of the present disclosure.

As illustrated in the example embodiment of FIG. 15, the first interaction area 82*a* is at least partially housed within the first and second through holes 104*a*, 104*b*, wherein the spacer element 83 spaces the connection bracket 102 from the drop end bracket 56. In this example embodiment, the second interaction area 82*b* is at least partially housed within and interacts with the one or more slide brackets 50*a*, 50*b* supporting movement along the y axis. The second interaction area 82*b* is buttressed by the connector 86 and the spacer element 83 and the first interaction area 82*a* is buttressed by the spacer element and the end bracket 84 when assembled. In one example embodiment, the end bracket 84 is flush with an outer surface of the drop end bracket 56. In another example embodiment, the one or more slide portions 48*a*, 48*b* rotate within the one or more slide brackets 50*a*, 50*b* and within the first and second through holes 104*a*, 104*b* when the second roll bar 54 is extending or retracting the drop screen 40. In yet another example embodiment, the one or more slide portions 48*a*, 48*b* are stationary within the one or more slide brackets 50*a*, 50*b* and within the first and second through holes 104*a*, 104*b* when the second roll bar 54 is extending or retracting the drop screen 40.

In one example embodiment, the one or more slide portions 48*a*, 48*b* comprise one of metal, plastic, or the like. In another example embodiment, the connector bracket 102 comprises one of metal, plastic, or the like. In another example embodiment, a diameter of the first and second through holes 104*a*, 104*b* are between 0.1 mm to about 2 mm greater than a diameter of the slide bracket interaction area 82. In yet another example embodiment, an inner width 51*b* of one or more slide portions 48*a*, 48*b* are between 0.1 mm to about 2 mm greater than the diameter of the slide bracket interaction area 82. In yet another example embodiment, an outer width 51*c* of one or more slide portions 48*a*, 48*b* are between 0.1 mm to about 2 mm greater than a diameter or width of the end bracket 84.

In the illustrated embodiment of FIGS. 12-15, the rotation mount 48*c* has a rotation bracket interaction area 92 coupling a retaining element 98 to an intermediate element 96, wherein the intermediate element is coupled to a body 100 of the second roll bar 54. In one example embodiment, the intermediate element 96 comprises an actuator, such as a motor, that extends and/or retracts the drop screen 40. The rotation mount 48*c* defines the rotation bracket interaction area 92 that is at least partially housed within and interacts with the rotation bracket 47 supporting the rotation of the second roll bar 54 and movement of the second roll bar along the y axis. The rotation bracket interaction area 92 is at least partially housed within the rotation through hole 106 of the connector bracket 102.

In one example embodiment, the rotation bracket interaction area 92 defines a top clip area 92*a* and first and second lateral clip areas 92*b*, 92*c*. In this example embodiment, the rotation bracket interaction area 92 supports an end area 92*d* that extends beyond the retaining element 98 when assembled. Further in this example embodiment, the retaining element 98 comprises a top clip 98*a* that is complementary to the top clip area 92*a*, and first and second lateral clips 98*b*, 98*c* that are complementary to the first and second lateral clip areas 92*b*, 92*c*. In another example embodiment, the rotation bracket interaction area 92 defines additional clip areas, identical to the clip areas 92*a*, 92*b*, 92*c* that are located between the drop end bracket 56 and the second roll bar 54, that support a second retaining element. In one example embodiment, the rotation bracket interaction area 92 defines clip areas 92*a*, 92*b*, 92*c* on at least one of an outward facing side of the connection bracket 102 and between the drop end bracket 56 and the intermediate element 96.

Figure 13:
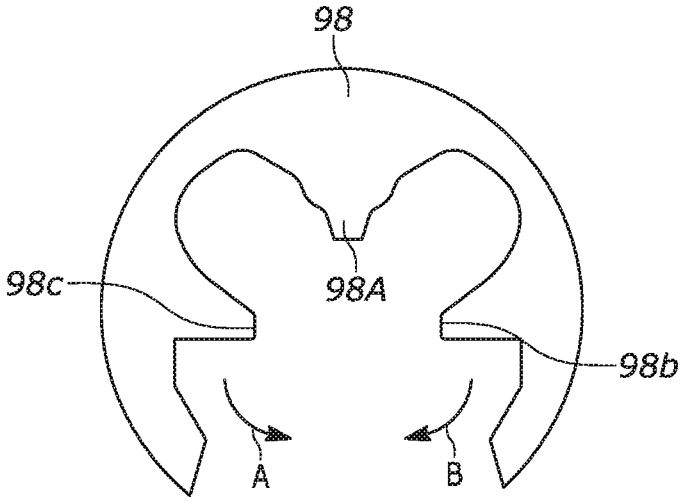
FIG. 13 is an elevation view of a retaining element in accordance with one example embodiment of the present disclosure.
Figure 14:
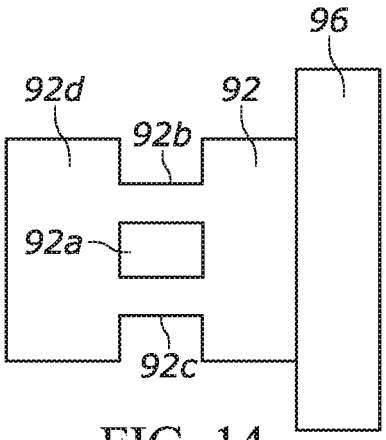
FIG. 14 is a plan view of a portion of a rotation bracket interaction area and intermediate element of a second roll bar in accordance with one example embodiment of the present disclosure.

As illustrated in the example embodiment of FIGS. 13 and 14, tension is created between the first and second clips 98*b*, 98*c* in directions A and B respectively, wherein the tension retains the retaining element 98 into the top clip area 92*a* and the first and second lateral clip areas 92*b*, 92*c*, thus coupling the second roll bar 54 to the roll bar 32.

Figure 12:
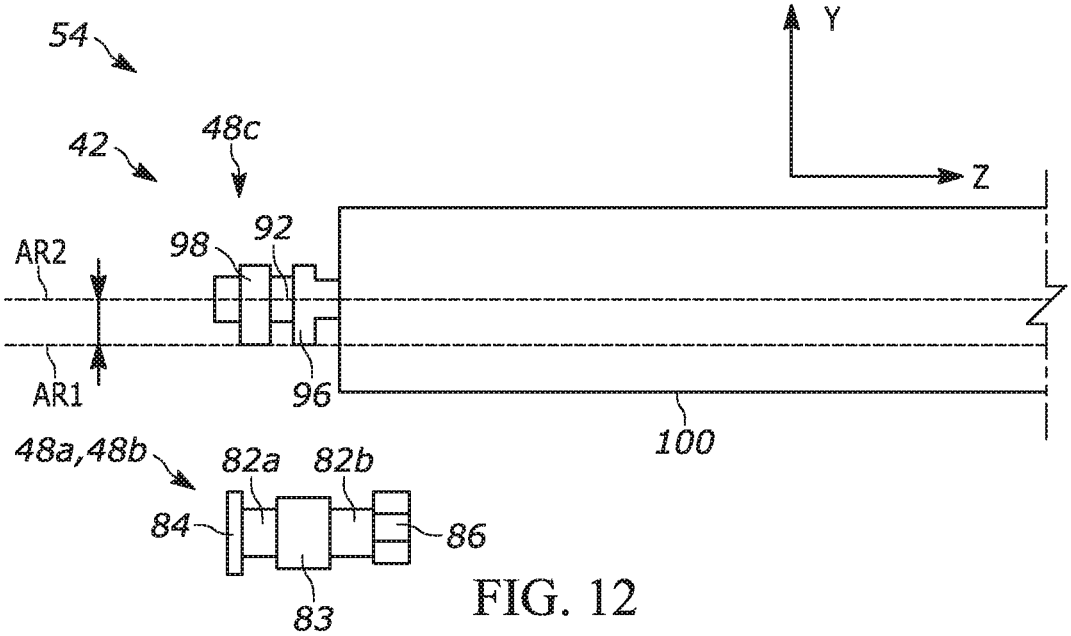
FIG. 12 is an elevation view of a partial second roll bar including a rotation mount and one or more slide portions in accordance with one example embodiment of the present disclosure.

As illustrated in the example embodiment of FIGS. 12 and 15, the inner roller mechanism 42 allows for independent rotation of the second roll bar 54 about multiple axis, wherein the inner roller mechanism rotates between a first axis of rotation AR1 (e.g., when the drop shade 40 is extended) to a second axis of ration AR2 (e.g., when the drop shade is retracted). Stated another way, an axis of rotation about which the inner roller mechanism 42 rotates moves along the y direction between the first axis of rotation AR1 to the second axis of rotation AR2.

Wherein, the one or more slide portions 48*a*, 48*b* in conjunction with the one or more slide brackets 50*a*, 50*b*, and the first and second through holes 104*a*, 104*b* prevent unwanted motion along an x direction (see x-y coordinates in FIGS. 4-6B) while allowing the second roll bar 54 to move along a y direction. The rotation mount 48*c* and/or the one or more slide portions 48*a*, 48*b* comprise an attachment (e.g., the slide connector 86 and the retaining element 98) such as a threaded attachment assembly (e.g. a lug nut and screw), a bolted attachment (e.g. a bolt), a welded attachment, and/or a combination thereof.

As illustrated in the example illustrated embodiments of FIGS. 6A-9, the screen 40 extends from the second roll bar 54 through the first opening 33 of the roll bar 32. In one example embodiment, the first opening length 33*a* is between 1 cm to about 10 cm larger than a drop screen length 40*a* of the drop screen 40. As further illustrated in the example embodiments of FIGS. 7-11, the drop screen 40 is coupled to the second roll bar 54 at a first end 72*a* and extends out of the first opening 33 when assembled. In this example embodiment, the second end 72*b* of the drop screen 40, opposite the first end 72*a*, is coupled to a stop 66. In one example embodiment, the stop 66 comprises plastic, rubber, and/or metal. The stop 66 is weighted, such that the drop screen 40 is kept taught based upon gravity. In one example embodiment, the stop 66 is between 1 lb to about 5 lb. The stop 66 is one of rectangular, polygonal, or the like. In one example embodiment, the stop 66 is rectangular with an arced interior surface along a top face 67*a*, wherein the arced interior surface complements an arced outward surface 32*b* of the roll tube 32. In another example embodiment, a rear face 67*b* of the stop 66 also comprises an arced surface that complements the arced outward surface 32*b* of the roll tube 32.

In one example embodiment, such as when the drop shade 40 is retracted, the stop 66 at least partially covers the first opening 33. In this embodiment, the top face 67*a* of the stop 66 interacts with the outward face 32*b* of the roller tube 32. The rear face 67*b* extends outwardly and is flush with the roll tube 32. In the illustrated example embodiment of FIG. 5, the stop 66 covers the first opening 33, wherein the canopy 26, when retracted, is spooled over the stop. It would be understood by one having ordinary skill in the art that the stop 66 may be configured such that the stop would not be visible from the view illustrated in FIG. 5.

The stop 66 is attached to the drop screen 40 at least one of on center C or off center. In the illustrated example embodiment of FIGS. 10-11, the drop screen 40 is attached to the stop 66 off center C, wherein the second end 72*b* is connected between 10% to 40% off center C such that the center C is nearer a roll center CR of the second roll bar 54.

Figure 6A:
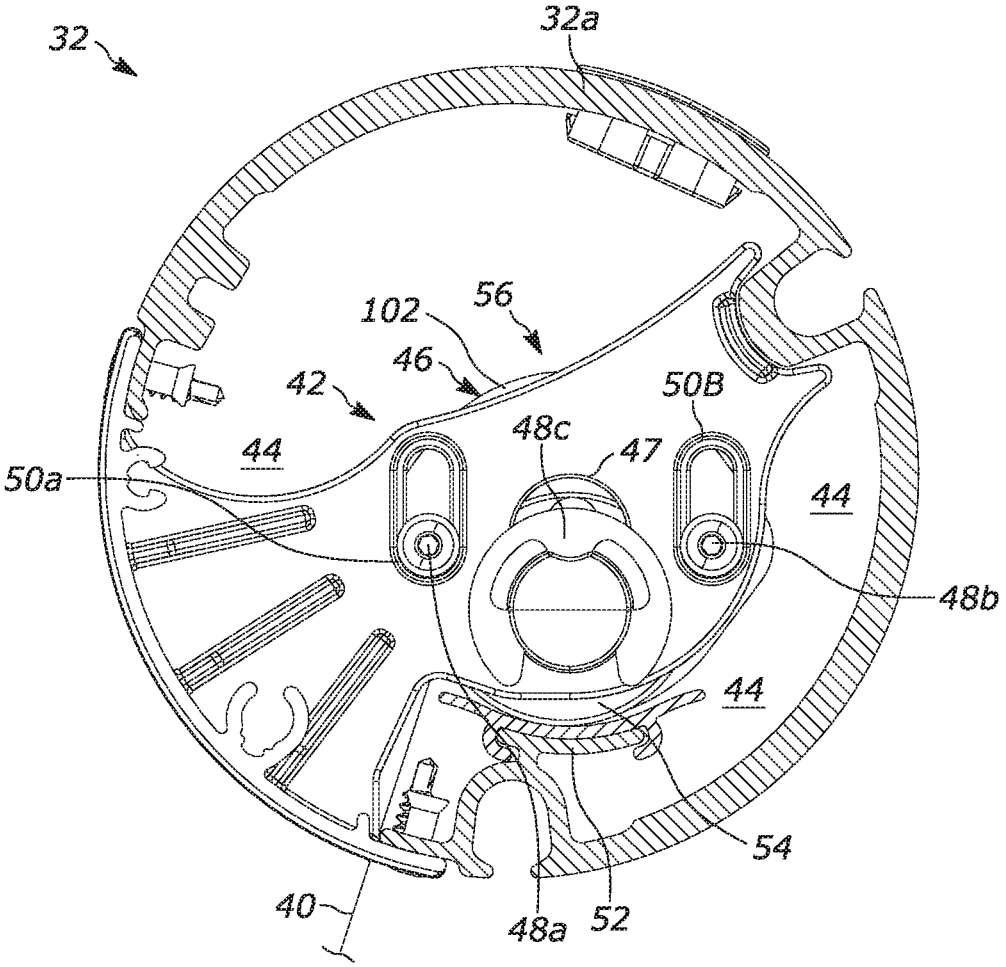
FIG. 6A is a left side interior elevation view of FIG. 4 with an extended screen of an awning canopy assembly support system in accordance with another example embodiment of the present disclosure.
Figure 6B:
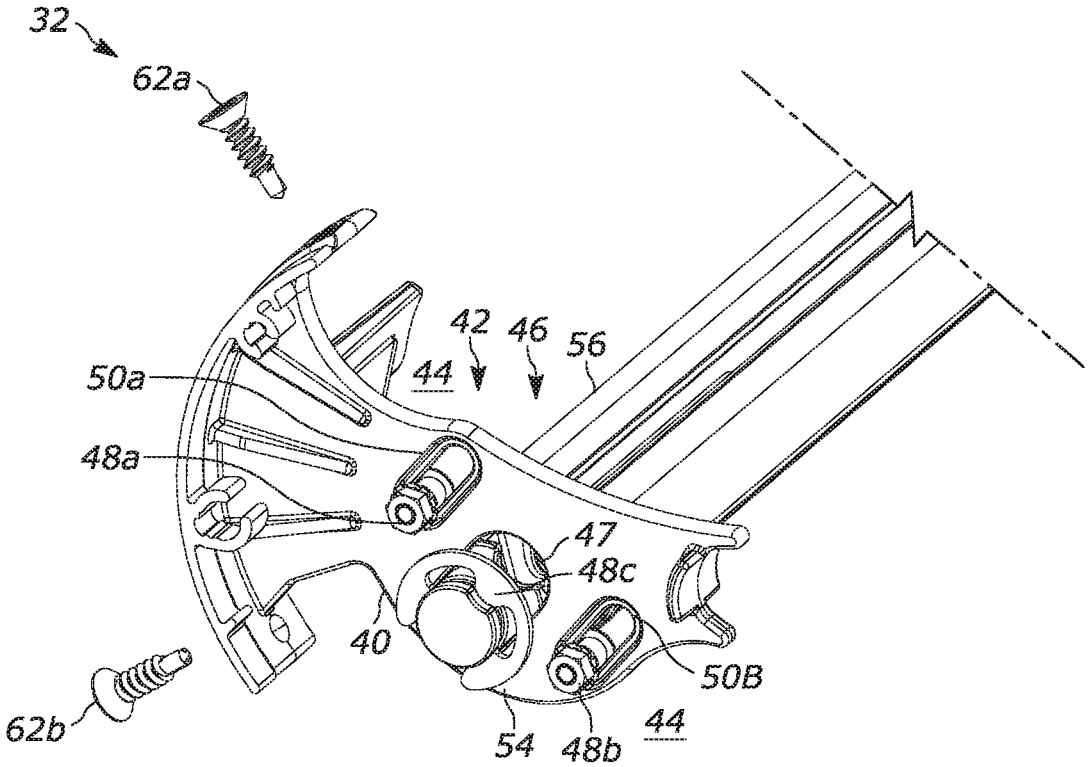
FIG. 6B is a left side interior elevation view of FIG. 4 wherein a portion of a roll bar is absent with an extended screen of an awning canopy assembly support system in accordance with another example embodiment of the present disclosure.
Figure 7:
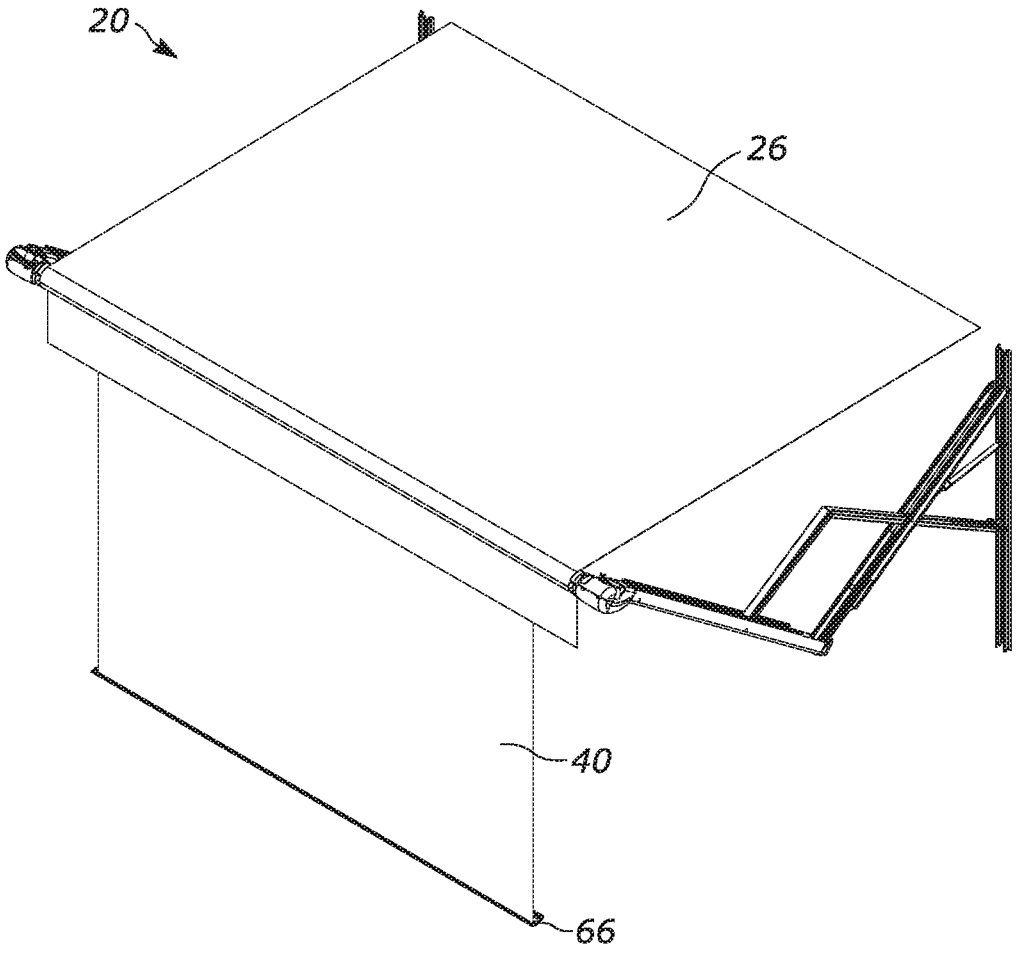
FIG. 7 is a perspective view of an awning canopy assembly in an open or expanded position including an unrolled screen in accordance with another example embodiment of the present disclosure.
Figure 8:
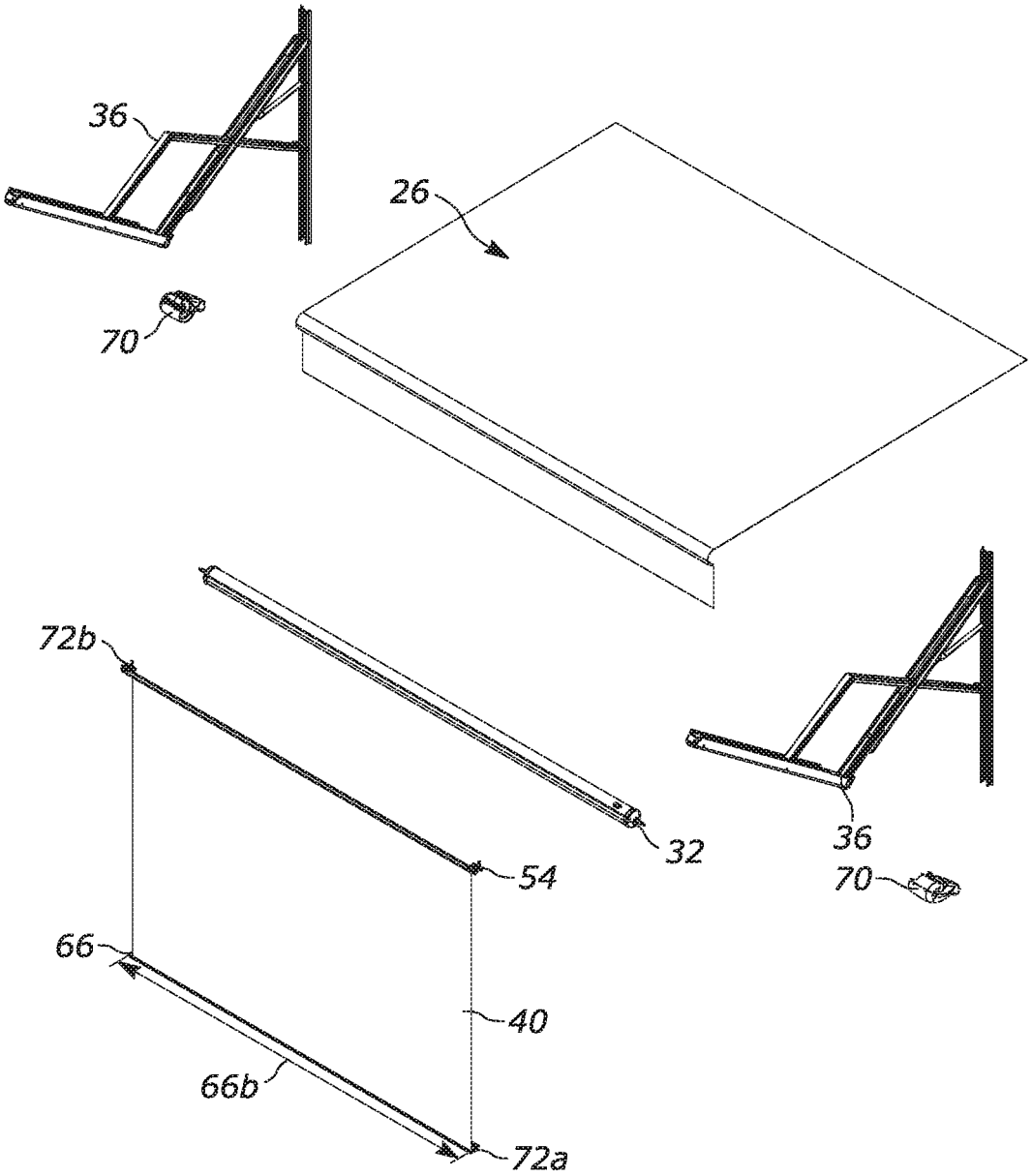
FIG. 8 is an exploded view of FIG. 7.
Figure 9:
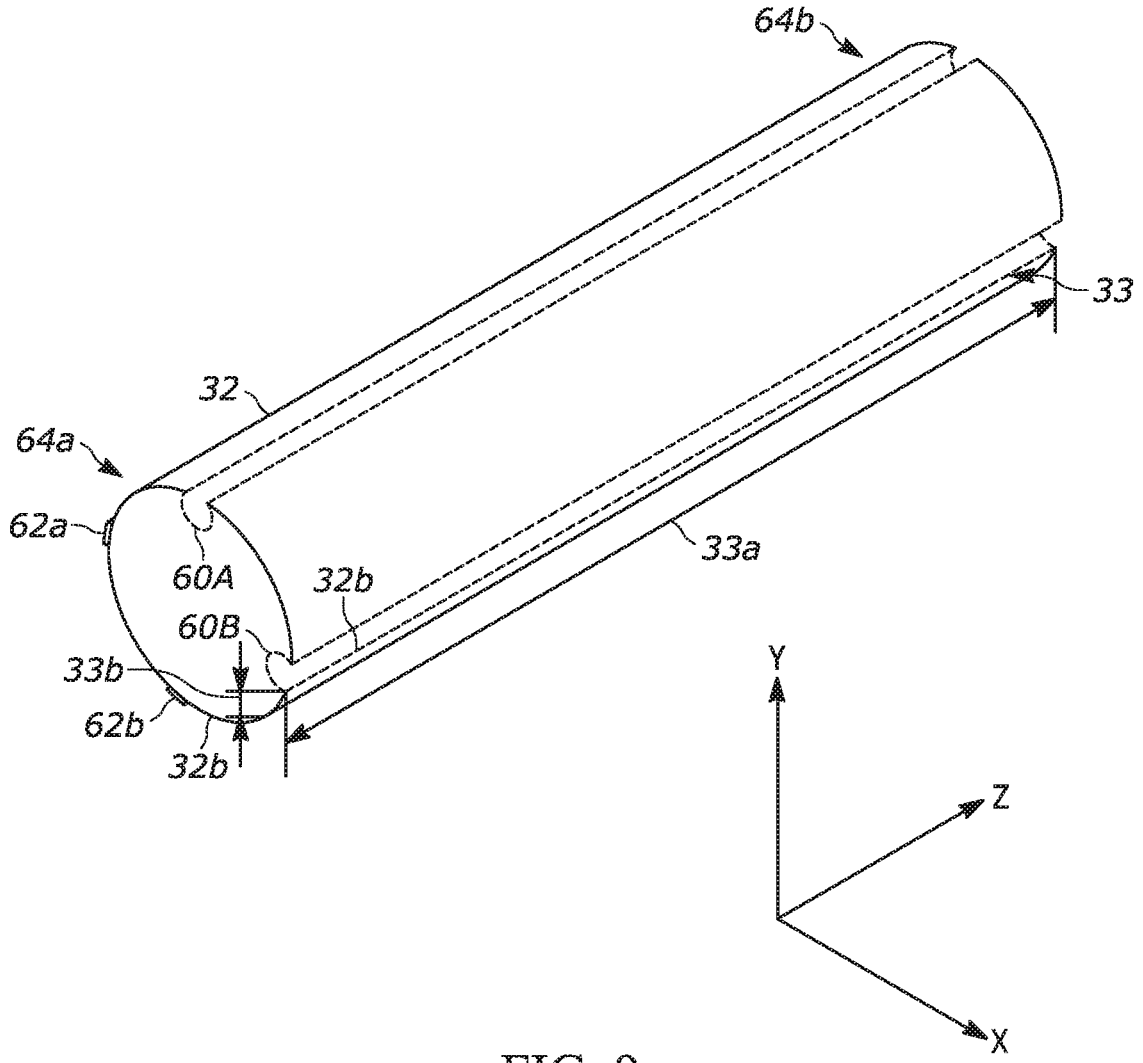
FIG. 9 is a simplified version of a roll bar in accordance with another example embodiment of the present disclosure.
Figure 10:
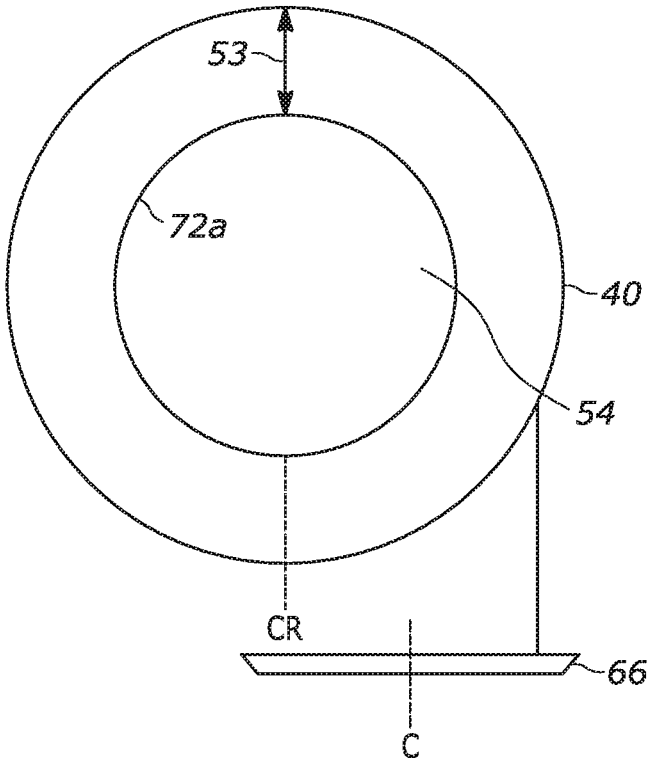
FIG. 10 is a cross-section view taken along lines 10-10 of FIG. 5.
Figure 11:
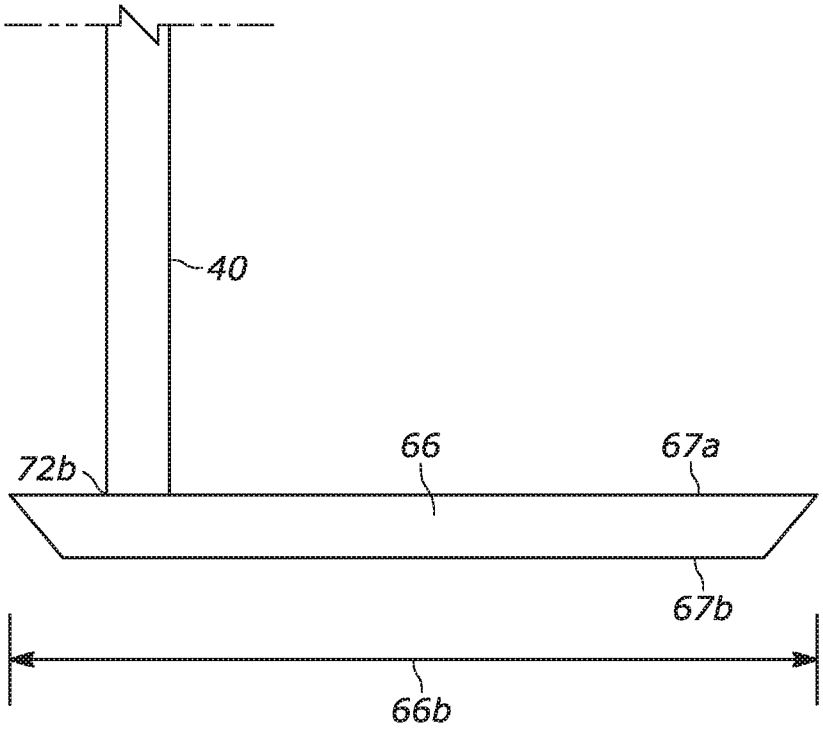
FIG. 11 is a magnified view of a stop in accordance with one example embodiment of the present disclosure.

In one example embodiment, the second roll bar 54 is added to the roll bar 32 by removing the replaceable roller tube portion 32*a* by removing the connectors 62*a*, 62*b*. The slide bracket interaction area 82 of each of the one or more slide portions 48*a*, 48*b* is inserted into the one or more slide brackets 50*a*, 50*b*. The spacer elements 83 are coupled to the slide bracket interaction areas 82 of each of one or more slide portions 48*a*, 48*b*, the slide bracket interaction area is further inserted into the first and second through holes 104*a*, 104*b*. The slide connector 86 is secured to the first interaction area 82*a* of the slide bracket interaction area 82 opposite the end bracket 84 across the first and second through holes 104*a*, 104*b* and the one or more slide brackets 50*a*, 50*b* to retain the one or more slide portions 48*a*, 48*b* within the first and second through holes and one or more slide brackets. The rotation bracket interaction area 92 is inserted into the rotation bracket 47 and the rotation through hole 106 and the retaining element 98 is secured to the rotation bracket interaction area opposite the intermediate element 96 across the rotation bracket to retain the rotation mount 48*c* within the rotation bracket and the retaining element. The drop screen 40 is extended through the first opening 33. The replaceable roller tube portion 32*a* is attached via the connectors 62*a*, 62*b* to comprise an assembled awning assembly.

Wherein a tray 52 supported by the replaceable roller tube portion 32*a*, supports the second roll bar 54 of the inner roller mechanism 42, such that as the screen 40 is unrolled the second roll bar 54 moves toward the tray 52 until the second roll bar 54 rests upon the tray directly (see FIG. 6A). Providing the tray 52 for the second roll bar 54 minimizes the deflection (e.g., movement along the x directions) in the second roll bar and maintains even tension on the fabric of the screen 40 during unrolling/extension and rolling/retraction. The roll bar 32, the second roll bar 54, the end drop bracket 56, and/or the removable and replaceable roller tube portion 32*a* comprise one of metal, plastic, or the like. The roll bar 32, the second roll bar 54, the end drop bracket 56, and/or the removable and replaceable roller tube portion 32*a* are formed by molding, extrusion, welding, and/or some combination thereof. In one example embodiment, the one or more slide brackets 50A, 50B are oblong. In another example embodiment, the one or more slide brackets 50A, 50B have a bracket length 51*a* equal to a rolled thickness 53 of the screen 40 (see FIGS. 5 and 10).

Even tension on the screen 40 during extension and retraction promotes favorable roll up (e.g. the screen 40 fabric stays even along the x-direction) and reduces the risk of wrinkling. It would be understood by one having ordinary skill in the art that the inner roller mechanism 42 may utilize an electric motor, a torsion spring, or the like to extend and retract the screen 40.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An awning assembly comprising:

a first roll bar extending along a lateral axis between first and second arms, the first roll bar comprising:

a removable and replaceable roller tube portion defining an opening within the first roll bar; and an inner roller mechanism housed within the opening, the inner roller mechanism comprising:

a drop end bracket rotatably and slidably coupling a second roll bar to opposing ends of the first roll bar via a connector bracket, the connector bracket defining first and second through holes spaced by a rotation through hole, the drop end bracket defining first and second slide brackets and a rotation bracket, wherein first and second slide portions reside within the first and second through holes and slidably reside within the first and second slide brackets, further wherein a rotation mount coupled to the inner roller mechanism extends through the rotation bracket and the rotation through hole, such that the rotation mount is rotatable within the rotation bracket and the rotation through hole, the second roll bar extending laterally within the first roll bar; and a material supported by the second roll bar, wherein the material is extendable or retractable responsive to rotation of the second roll bar.

2. The awning assembly of claim 1, further comprising a tray supporting the second roll bar during extension and retraction of the material, the tray supported by the removable and replaceable roller tube portion.

3. The awning assembly of claim 1, the drop end bracket spaces the rotation mount that is secured to the inner roller mechanism from the connector bracket.

4. The awning assembly of claim 3, wherein the first and second slide portions couple the second roll bar to the first roll bar.

5. The awning assembly of claim 4, wherein the first and second slide portions move along a first axis responsive to the second roll bar extending or retracting, the first axis transverse to the lateral axis.

6. The awning assembly of claim 4, wherein the first and second slide portions each comprise a slide connector and an end bracket coupled together by a slide bracket interaction area.

7. The awning assembly of claim 6, wherein the slide bracket interaction areas of the first and second slide portions are at least partially housed within the first and second through holes.

8. The awning assembly of claim 7, further comprising the rotation mount further at least partially housed within the connector bracket, wherein the rotation mount moves along a first axis responsive to the second roll bar extending or retracting, the first axis at least one of transverse or perpendicular to the lateral axis.

9. The awning assembly of claim 3, further comprising the rotation mount at least partially housed within and supported by the rotation bracket, the rotation mount moves along a first axis responsive to the second roll bar extending or retracting, the first axis at least one transverse or perpendicular to the lateral axis.

10. The awning assembly of claim 8, further wherein an axis of rotation about which the rotation mount rotates moves along the first axis between a first axis of rotation to a second axis of rotation during rotation of the second roll bar.

11. The awning assembly of claim 1, the material coupled to the second roll bar at a first end of the material and to a stop at a second end of the material, the first end opposite the second end, the stop configured to cover the opening when the material is retracted.

12. An awning assembly comprising:

a first roll bar supporting a canopy, the canopy couplable to a dwelling at a first end and coupled to the first roll bar at a second end, the first roll bar extends along a lateral axis between first and second arms, the first and second arms are couplable to the dwelling at a first arm end, and supporting the first roll bar at a second arm end, the first and second arms extend and retract the canopy by extending or retracting the arms, the first roll bar comprising:

a) a removable and replaceable roller tube portion defining an opening within the first roll bar;

b) an opening extending along the lateral axis; and c) an inner roller mechanism comprising a second roll bar housed within the opening, the inner roller mechanism comprising;

1) A drop end bracket defining first and second slide brackets spaced by a rotation mount, first and second slide portions at least partially housed within first and second slide brackets, the first and second slide portions movably supporting the second roll bar during rotation and the rotation mount at least partially housed within a rotation bracket rotatably and slidably coupling the second roll bar to the first roll bar, the second roll bar extending laterally within the first roll bar;

2) A connecting bracket defining first and second through holes and a rotation through hole, the first and second slide portions at least partially housed within the first and second through holes, such that the rotation mount is rotatable within the rotation bracket and the rotation through hole; and 3) A material supported by the second roll bar and extending through the opening, wherein the material is extendable or retractable responsive to rotation of the second roll bar.

13. The awning assembly of claim 12, further comprising a tray supporting the second roll bar during extension and retraction of the material, the tray supported by the removable and replaceable roller tube portion.

14. The awning assembly of claim 12, wherein the first and second slide portions move along a first axis within the first and second slide brackets responsive to the second roll bar extending or retracting, the first axis transverse to the lateral axis, further wherein the one or more slide brackets rotationally interact with the second roll bar.

15. The awning assembly of claim 14, wherein the first and second slide portions further comprise a slide connector coupled to the end bracket by a slide bracket interaction area, further wherein the slide bracket interaction area is at least partially housed within one of the first and second slide brackets and the first and second through holes.

16. The awning assembly of claim 15, the rotation mount at least partially housed within the rotation through hole, the interaction of the rotation mount and first and second slide portions with the connecting bracket and the one or more slide brackets inhibiting motion along a second axis, wherein the second axis is perpendicular to the lateral axis and the first axis, the lateral axis perpendicular to the first axis.

17. The awning assembly of claim 16, further comprising the rotation mount moving along the first axis responsive to the second roll bar extending or retracting, further wherein an axis of rotation about which the rotation mount rotates moves along the first axis between a first axis of rotation to a second axis of rotation.

18. The awning assembly of claim 12, the material coupled to the second roll bar at first end of the material and to a stop at a second end of the material, the stop configured to cover the opening when the material is retracted.

19. The awning assembly of claim 12, the material comprising an SPF 50 or higher material.

20. An awning assembly comprising:

a first roll bar extending along a lateral axis between first and second arms, the first roll bar comprising:

a) a removable and replaceable roller tube portion defining an opening within the first roll bar; and b) an inner roller mechanism housed within the opening, the inner roller mechanism comprising:

1) A drop end bracket defining first and second slide brackets spaced by a rotation bracket;

2) A connecting element defining first and second through holes and a rotation through hole;

3) A rotation mount housed and rotatable within the rotation bracket and the rotation through hole, the rotation mount rotatably and slidably coupling a second roll bar to the first roll bar, the second roll bar extending laterally within the first roll bar, the rotation mount and first and second slide portions move along a first axis responsive to the second roll bar extending or retracting, further wherein the first and second slide brackets and the first and second through holes support one or more slide portions that interact with the second roll bar to inhibit movement along a second axis, the first axis transverse to the second axis and the lateral axis, and the second axis transverse to the lateral axis;

4) A material supported by the second roll bar, wherein the material is extendable or retractable responsive to rotation of the second roll bar; and 5) A tray supporting the second roll bar during extension and retraction of the material, the tray supported by the removable and replaceable roller tube portion.

* * * * *